US005974914A

United States Patent [19]

Belanger

[11] Patent Number: 5,974,914

[45] Date of Patent: Nov. 2, 1999

[54] ERGONOMIC SPIKE-CHANGING WORK STATION

[76] Inventor: Stephen B. Belanger, 8123 SE. Carlton St., Hobe Sound, Fla. 33455

[21] Appl. No.: 08/823,819

[22] Filed: Mar. 25, 1997

[51] Int. Cl.[6] ..... B25B 17/00

[52] U.S. Cl. ..... 81/57.4; 211/34

[58] Field of Search ..... 81/54, 57.4, 57.24; 269/17, 43, 46, 69, 99, 100, 34, 35, 36, 15, 16; 211/90.01; 248/317

[56] References Cited

U.S. PATENT DOCUMENTS

| | | | |
|---|---|---|---|
| 1,720,893 | 7/1929 | Glidden | 211/34 |
| 2,034,740 | 3/1936 | Brandt | 81/57.4 |
| 2,905,194 | 9/1959 | Smith et al. | 81/180.1 |
| 3,016,774 | 1/1962 | Minobe | 81/54 |
| 3,024,480 | 3/1962 | Baker et al. | 211/34 |
| 5,116,264 | 5/1992 | Wiederrich et al. | 269/17 |
| 5,367,924 | 11/1994 | Henson et al. | 81/57.4 |

*Primary Examiner*—David A. Scherbel
*Assistant Examiner*—Joni B. Danganan
*Attorney, Agent, or Firm*—Malin, Haley, DiMaggio & Crosby, P.A.

[57] ABSTRACT

An ergonomic work station is disclosed for relative quick removal and conversion of golf shoes from metal spikes to non-metal spikes. The work station includes a frame member having an adjustable support member attached thereto, with one or more shoe holders associated with the support member for maintaining the golf shoes in an upside down (sole up) position. A push to start electric screwdriver or drill member, having spike changing bits, is hung and balanced from the top of the frame member. Preferably, the screwdriver or drill member is allowed to slide along the top of the frame member in order to be adjacent the shoe holder which is maintaining the shoe to have its spikes removed or converted. The screwdriver or drill member is balanced from the top of the frame such that the individual utilizing the screwdriver or drill is not required to exert any stress to maintain the screwdriver or drill in its proper position.

20 Claims, 4 Drawing Sheets

ERGONOMIC SPIKE-CHANGING WORK STATION

BACKGROUND OF THE INVENTION

1. Field of the Invention

The present invention relates generally to the sport of golf and more particularly to an ergonomic work station for changing spikes on golf shoes.

2. Description of the Prior Art

For many years golfers have worn golf shoes having metal spikes extending downward from the soles of the shoes. The spikes are provided to prevent the golfer from sliding while he or she is swinging a golf club. Thus, the spikes provide for better traction and help to increase the accuracy of the golf shot.

Though the metal spikes have performed their job sufficiently with respect to preventing sliding, several disadvantages have become apparent with the wearing of metal spikes by golfers. Some of these disadvantages include:

(1) spike marks on the putting greens which can effect the travel of a putted golf ball;

(2) damage to delicate root structures of putting greens and other turfs which often causes significant soil compaction and delayed grass recovery for weeks beyond that of other shoes;

(3) wear and tear on floors, carpeting, furniture and outdoor walkways of the golf course's clubhouse, as well as wear and tear on golf carts and driving range mats;

(4) lawnmower blade damage often resulting in expensive repair costs;

(5) spikes falling off the golfer's shoes and onto the course; and (6) increase maintenance and replacement costs due to the turf damage, as well as the other damage and wear and tear discussed above.

In view of these significant disadvantages, many golf clubs have banned golfers from wearing metal spikes when the golfer is playing on their golf course or otherwise present at their facility.

To overcome the problems of metal spikes, while still providing for a secure grip of the golfer's feet while swinging his or her club, several manufacturers of golf shoes have begun to offer non-metal spikes, made from polyurethane, plastic or other composition material, as an alternative to and to replace metal spikes.

Various tools, including drills with special spike removing drill bits and wrenches, have been in use to remove the metal spikes and/or to replace the metal spikes with non-metal spikes. Typically, the removal and replacement of the spikes is done by individuals employed by the golf club. As more golf clubs have joined in the ban of metal spikes at their facilities, the demand for spike changing has increased, and is currently requiring golf clubs to hire one or more individuals specifically for converting metal spike golf shoes to non-metal spike golf shoes.

Though, the conversion of golf shoes to non-metal spikes has many advantages, some of which are described above, one immediate problem is the potential for injury, caused by repetitive movement over an extended period of time, especially to the individuals who are converting golf shoes on a regular basis. These type of injuries are often referred to a "repetitive stress injuries", and include everything from tendinitis to lower back strain, as well as carpal tunnel syndrome. Typically, each golf shoe is provided with approximately twelve (12) metal spikes. As the demand for golf shoe spike conversion or changing increases, more and more individuals may be exposed to these types of injuries from utilizing drills, wrenches or other tools constantly throughout the day.

Thus, what is needed in the art is an ergonomic work station which will allow for the relatively quick removal and/or changing of golf shoe spikes while also substantially reducing, if not eliminating, injuries associated with repetitious movements over a period of time.

SUMMARY OF THE INVENTION

The present invention provides an ergonomic work station which is utilized for relative quick removal and conversion of golf shoes from metal spikes to non-metal spikes, while reducing injuries associated from the repetitious movement of changing golf shoe spikes on a regular basis. In the primary embodiment of the present invention a movable work station is provided which includes a frame member having an adjustable support member attached thereto, with one or more shoe holders associated with the support member for maintaining the golf shoes in an upside down (sole up) position.

A "push to start" electric screwdriver or drill member, having a spike changing bit, is hung and balanced from the top of the frame member. Preferably, the screwdriver or drill member is allowed to slide along the top of the frame member in order to be adjacent the shoe holder which is maintaining the shoe to have its spikes removed or converted. The screwdriver or drill member is balanced from the top of the frame such that the individual utilizing the screwdriver or drill is not required to exert any stress to maintain the screwdriver or drill in its proper position. Accordingly, the weight of the screwdriver or drill is not felt by the individual. In the preferred embodiment, a push to start electric screwdriver is chosen over the drill member, to eliminate stress associated with having to press a trigger mechanism of the drill member over an extended period of time.

Preferably, from four to eight shoe holders are provided which are each attached to the support member. Each shoe holder can be adjustable in an horizontal direction. The support member is preferably, adjustably attached to the frame member, in order to allow the support member to be move in a vertical direction to correspond to differences in height of the individuals changing the spikes. The frame member can be provided with a plurality of casters or rollers to aid in moving or transporting the work station.

In use, a golf shoe which is to be changed to non-metal spikes or just have its metal spikes removed or replaced, is positioned on the shoe holder in an upside position to provide easy access to the spikes. The mechanism utilized for balancing the screwdriver or drill, is slid along the top of the frame member, to position the screwdriver or drill adjacent the shoe to be worked on. The vertical height of the upside down shoe can be adjusted by moving the support member up or down along the frame, as desired by the worker. Furthermore, the horizontal position of the shoe can be adjusted, by sliding the adjustable portion of the shoe holder, also as desired by the worker. When all the spikes on the shoe have been, replaced, converted, changed and/or removed, the worker merely slides the balancing mechanism along the top of the frame, to position the screwdriver or drill next to the next shoe to be changed which ideally is positioned on one of the other provided shoe holders. Thus, the worker is provided with a screwdriver or drill appearing not to have any weight, and with the shoes in an ideal position, the job of changing the shoes on a repetitive basis is made relatively comfortable and relaxing to the worker.

Accordingly, it is an object of the present invention to provide an ergonomic work station for converting, changing, replacing and/or removing spikes on golf shoes in a manner which reduces injuries to the worker.

It is another object of the present invention to provide and ergonomic work station for converting, changing, replacing and/or removing spikes on golf shoes in a relatively quick and easy manner.

It is also another object of the present invention to provide an ergonomic work station for converting, changing, replacing and/or removing spikes on golf shoes wherein a substantial amount of the weight of the spike removal device is not felt by the user.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figures 1, 2, 3:
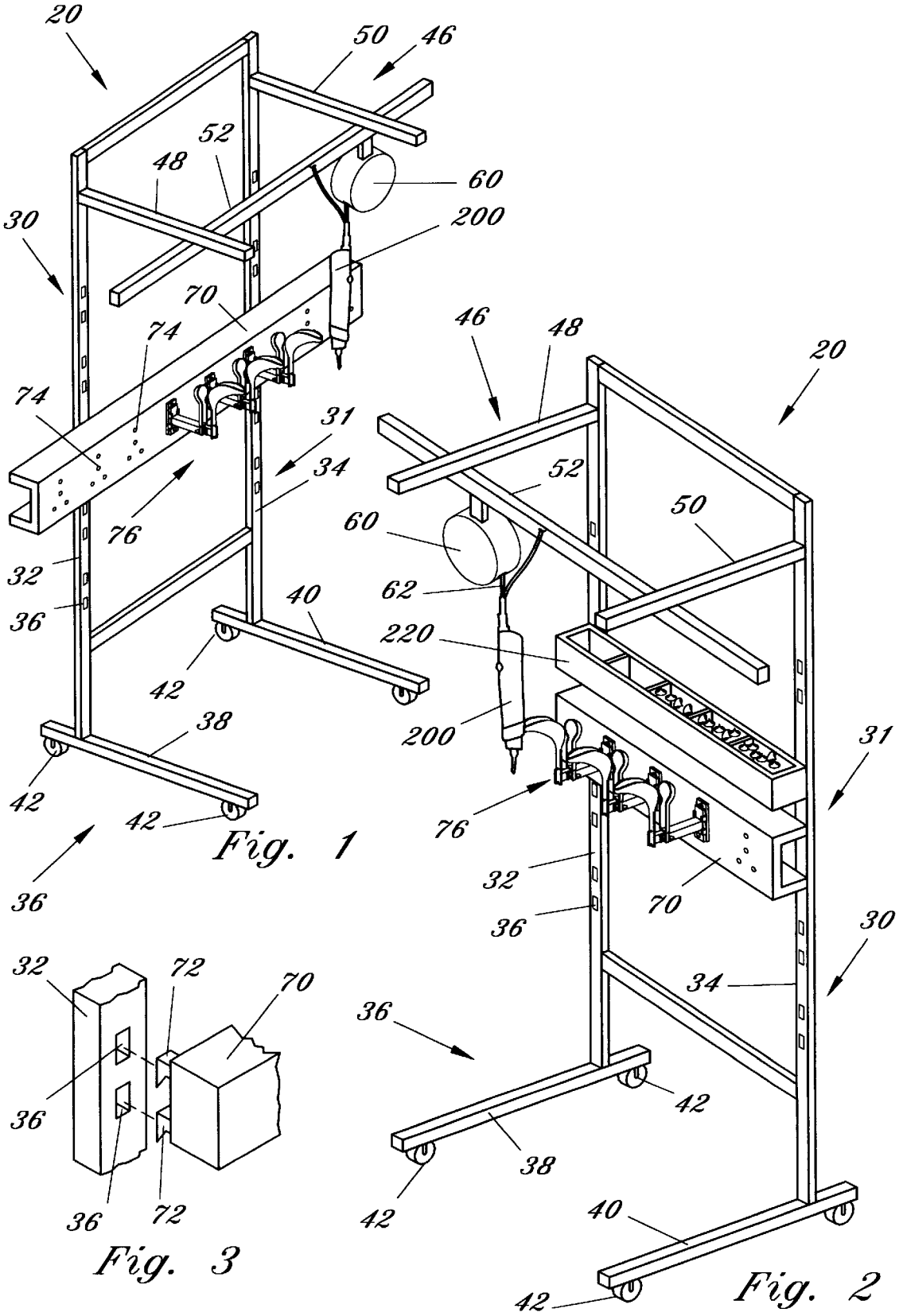
FIG. 1 is a first isometric view of the ergonomic spike-changing work station in accordance with the present invention.
FIG. 2 is a second isometric view of the ergonomic spike-changing work station in accordance with the present invention.
FIG. 3 is a cutaway isometric view illustrating the preferred attachment device for attaching the support member to the frame.

As seen in FIGS. 1 and 2, the preferred embodiment of the present invention ergonomic spike changing work station is generally reference as reference numeral 20. Work station 20 generally includes a frame member 30 which consists of a vertical portion 31, a bottom portion 36 and a top portion 46. Vertical portion 31 preferably consist of a pair of vertically disposed beams 32 and 34 which are connected at their uppermost end to top portion 46, and are attached at their lower ends to base portion 36.

In one embodiment bottom portion 36 consists of a pair of horizontally disposed base beams 38 and 40. Preferably, attached to the bottom surfaces of base beams 38 and 40 are one or more wheels, casters or rollers 42 for transporting work station 20. In lieu of casters 42, conventional stop or feet members 44 can be provided to prevent work station from sliding or otherwise moving during a spike changing operation. Furthermore, where casters or rollers 42 are provided, a conventional braking mechanism, similar to those found on baby carriages, can be provided to lock the wheels in place to prevent sliding or movement of frame member 30 during operation. Alternatively, the frame member can be attached to a wall by conventional means.

Top portion 46, in one embodiment includes a pair of horizontally disposed beams 48 and 50 and a cross beam 52. Cross beam 52 is provided with a groove or track (not shown) for receipt and positioning of a balancing mechanism 60, discussed further below.

Other structural configurations for frame member 30 are possible and are considered within the scope of the invention. Vertical portion 31, bottom portion 36 and top portion 46 can be constructed integral to form a one-piece frame member. Alternatively, some or all of the various components of frame member 30 can be individual pieces attached to each other by conventional means to form frame member 30.

An adjustable support member 70 is preferably removably attached to vertical portion 31. In the preferred embodiment, vertical beams 32 and 34 are provided with a series of slots 36 (FIGS. 1, 2 and 4) extending along a majority of the length of beams 32 and 34. Support member 70 is provided with attachment flanges 72. When attaching support member 70 to frame member 30, flanges 72 are inserted within certain slots 36 along beams 32 and 34 to position support member 70 at a desired height.

Figure 4:
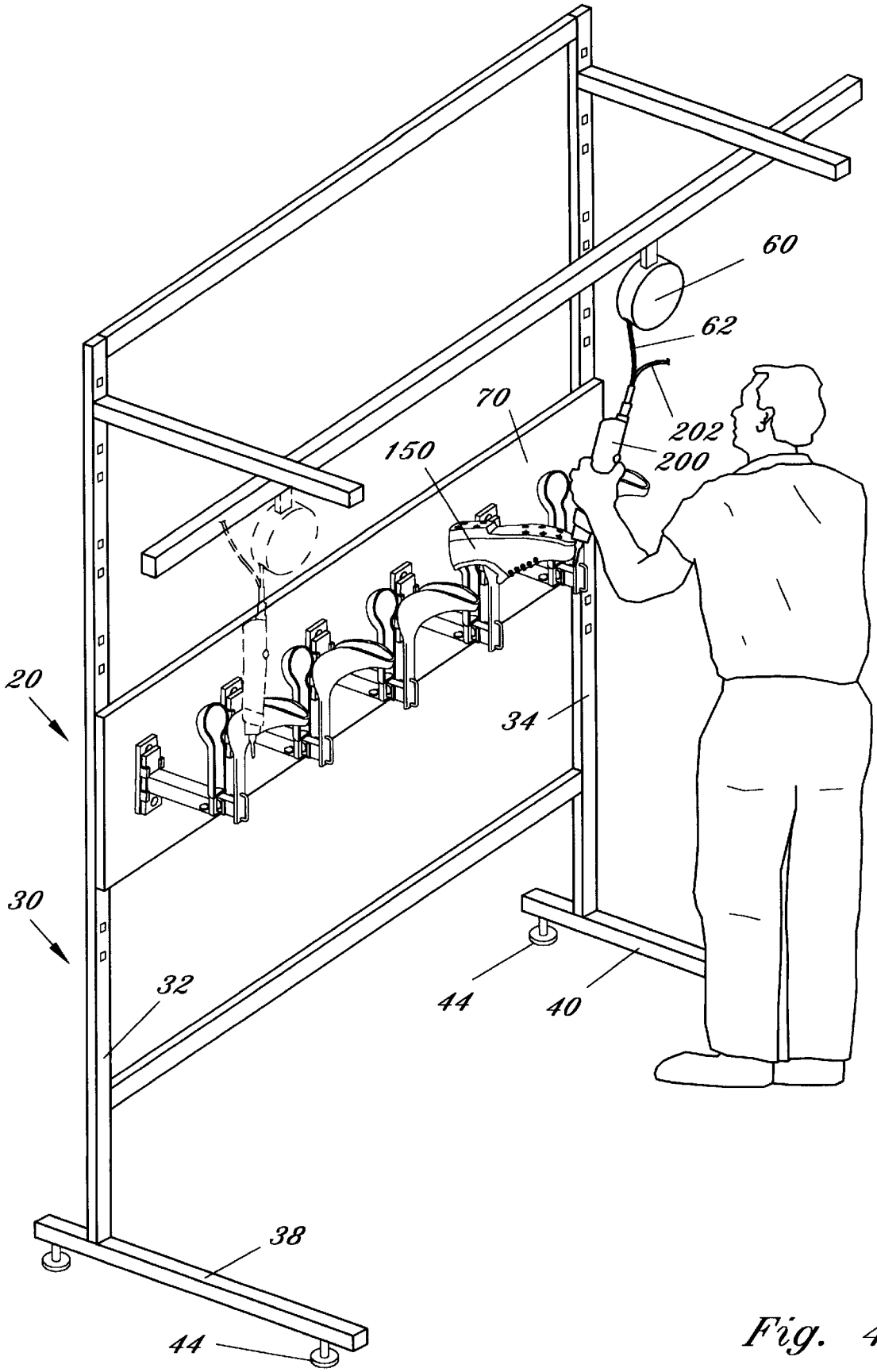
FIG. 4 is a isometric view of the ergonomic spike-changing work station illustrating an alternative support member embodiment.
Figure 5:
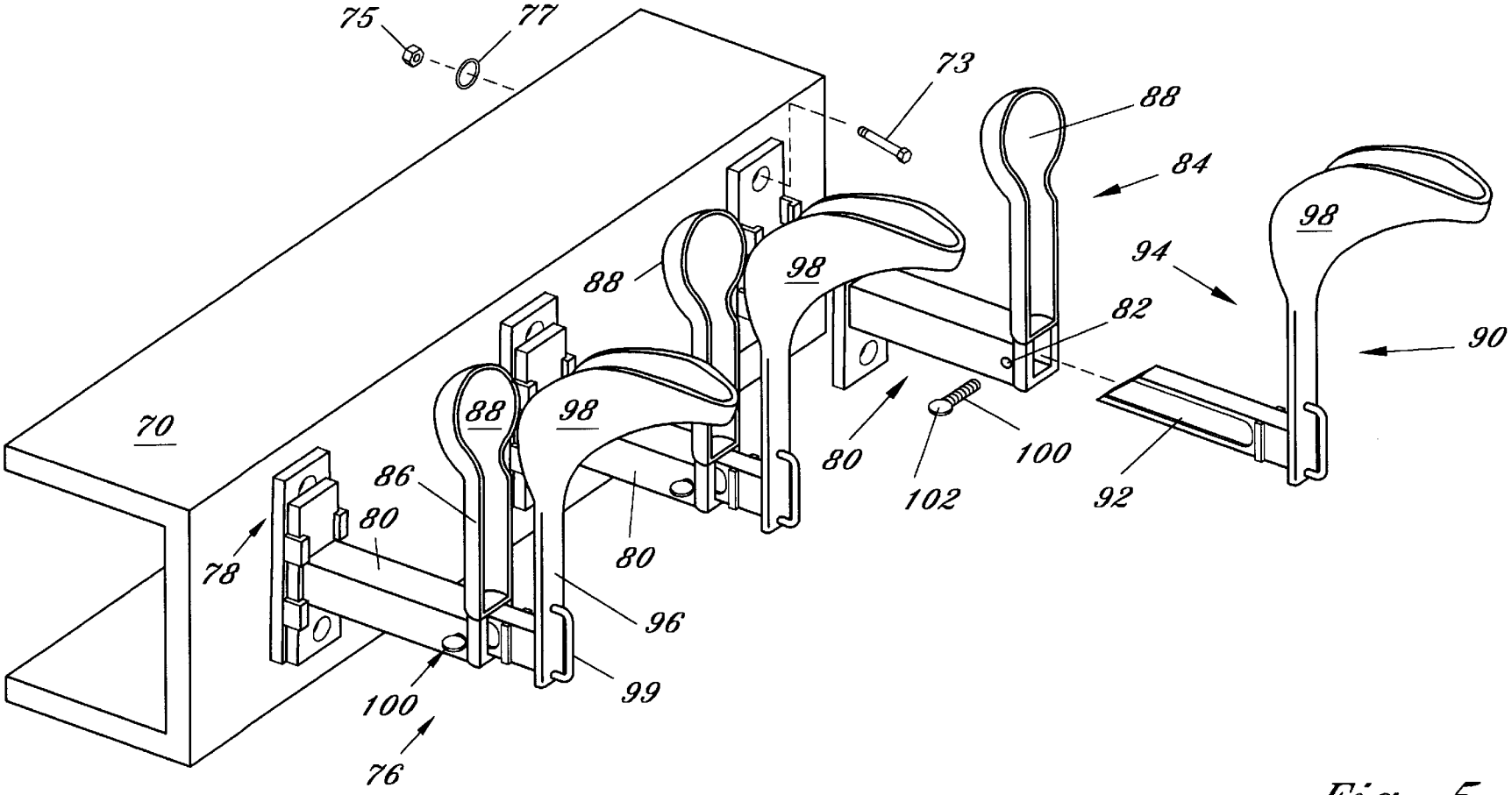
FIG. 5 is a isometric view illustrating the support member and shoe holder of the present invention.

In one embodiment, support member 70 is preferably rectangular in shape (FIG. 4). In the preferred embodiment, support member 70 is constructed from metal or a metal-like material and can have a shape resembling the letter "C" (FIGS. 1 and 2). Other materials and shape configuration can be utilized for the support member and are considered within the scope of the invention.

A plurality of shoe holders 76 are attached to support member 70 by conventional means. Where support member 70 is constructed from wood (FIG. 4), shoe holders 76 are conventionally attached to support member by wood screws (not shown) which are inserted through apertures (not shown) of an attachment section 78 of shoe holder 76 and into support member 70.

Where support member 70 is constructed from metal or a metal-like material (FIGS. 1 and 2), support member 70 is provided with apertures 74 which correspond to the apertures (not shown) in attachment section 78 of shoe holder 76. To attach shoe holder 76 to support member 70, the apertures in attachment section 78 are aligned with corresponding apertures 74 and corresponding threaded bolts 73 are inserted through attachment section apertures and apertures 74. A washer and nut combination 77 and 75, respectively, are associated with each corresponding inserted bolt 73 on the opposite side of support member 70 to complete the attachment of shoe holder 76 to support member 70.

Shoe holders 76 can be constructed from a plurality of materials such as plastic, cast-iron, steel, metal, etc. These materials are given by way of example and should not be considered limiting. Other materials can also be utilized for the construction of shoe holders 76 and are considered within the scope of the invention.

Preferably, a plurality of shoe holders 76 are provided and attached to support member 70. Where four (4) shoe holders 76 are provided (FIG. 2), support member 70 extends approximately thirty (30") inches in length and attachment flanges 72 are disposed at each end of support member 70. Where eight (8) shoe holders 76 are provided (FIG. 1), support member extends approximately sixty (60") inches in length and attachment flanges 72 are disposed approximately fifteen (15") inches inward, with each end of support member 70 extending outward beyond vertical beams 32 and 34. However, the number of shoe holders 76 provided, the approximate lengths for support member 70, and the location of attachment flanges 72, described above are all given by way of example and should not be considered limiting. Accordingly, other amounts, dimensions, and location can be selected and are considered within the scope of the invention.

In addition to attachment section 78, each shoe holder 76 is provided with a stationary section 80 and a movable section 90. Preferably, shoe holder 76 maintains an associated shoe, such as golf shoe 150, in an upside down position. Stationary section 80 includes a elongated channel 82 and is attached at one end to attachment section 78. A vertical shoe positioner 84 is attached to the opposite end of stationary section 80. Shoe positioner 84 includes a shaft 86 and a somewhat circular or elliptic top portion 88. Movable section 90 includes a post 92 which is removably and adjustably positioned within elongated channel 82 depending on the dimensions of the shoe to be serviced. A shoe holder 94 is attached to the outer end of post 92. Shoe holder 94 includes a shaft 96 and a shoe maintaining member 98. A handle 99 can also be provided for positioning movable section 90 with respect to stationary section 80.

A means for maintaining the position of movable section 90 with respect to stationary section 80 can be provided. Preferably, means for maintaining is a tension or locking member 100. For proper maintaining and positioning of the shoe to be serviced, such as shoe 150 (FIG. 4), post 92 is positioned within elongated channel 82, such that circular top portion 88 is abutting the back inside surface of the shoe 150 and maintaining member 98 is disposed within the area of shoe 150 where one's foot is normally placed. Once the proper positioning of post 92 is determined, a handle 102 of tensioning member 100 is turned until a portion of the tensioning member 100 abuts post 92 which locks post 92 in position by friction. In lieu of tensioning member 100. other conventional locking devices can be utilized. For example, channel 82 can be provided with an aperture and post 92 can be provided with a plurality of apertures. In this embodiment, the locking device consists of a pin member which is inserted through the aperture in channel 82 and the aperture of post 92 which is aligned with the channel 82 aperture. Other conventional locking devices are also considered within the scope of the invention.

As stated above, a balancing mechanism 60 is provided at top portion 46 and preferably disposed with a groove or track of cross beam 52 of top portion 46. A flexible cord or rope member 62 is attached at one end to balancing mechanism 60 and attached at its opposite end to the means for removing the spikes of a shoe 150 disposed upon shoe holder 76. As seen in the drawings, cord 62 extends downward from balancing mechanism to position the means for removing the spikes approximately at the same vertical height as shoe 150, in conjunction with adjusting the vertical height of support member 70 to correspond to the height of the user.

In the preferred embodiment means for removing the spikes is a "push to start" hand-held electric screwdriver 200 which can be provided with a magnetic hex head holder used in conjunction with different bits which fit over the spikes to be removed or replaced. The "push to start" feature is preferred as it is made for repetitious work, and helps to eliminate the stress associated with pressing and maintaining pressure on a conventional trigger mechanism. However, in lieu of electric screwdriver 200, other devices can be utilized as the means for removing such as a drill member 250 (FIG. 6), or other conventional electric or mechanic devices. A conventional electric cord 202 is also provided with electric screwdriver 200 or drill member 250 and is inserted at one end into an electrical outlet to provide power to screwdriver 200 or drill member 250 as is commonly known. However, it should be understood that screwdriver 200 or drill member 250 could be provided with a battery member as its power source in lieu of electric cord 202.

Screwdriver 200 is suspended by cord 62 from balancing mechanism 60. Balancing mechanism 60 supports at least a majority of the weight from screwdriver 200, or other spike removal devices, to alleviate stress caused by a user having to support such weight over an extended period of time.

By being disposed within the track of cross beam 52, balancing mechanism 60 is allowed to slide along at least the majority of the horizontal length of cross beam 52 to properly position screwdriver 200, or other spike removal device, adjacent to the shoe 150 to be serviced.

As seen in FIG. 2, an adjustable work shelf/container 220 can be provided for holding supplies such as spikes, drill bits, etc. Container 220 can be divided into one or more sections. Container 220 can be constructed from the same material as support member 70 and is preferably attached above support member 70 to frame 30 by attachment flanges (not shown but similar to attachment flanges 72 of support member).

Figure 6:
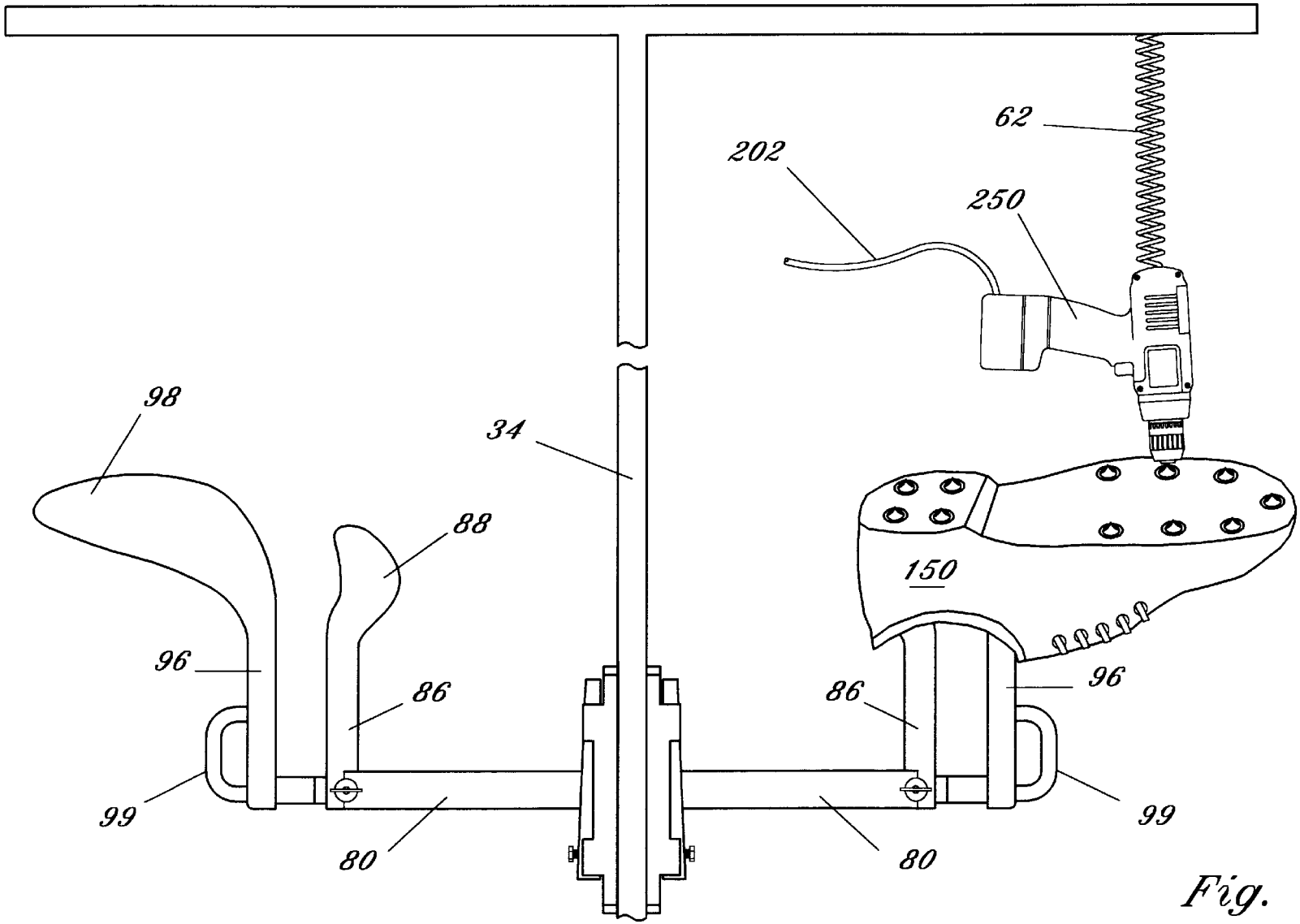
FIG. 6 is a side view illustrating an alternative embodiment of the present invention.

As seen in FIG. 6, frame 30 can be designed such that an ergonomic work station 20 is provided on both sides of frame 30. In this embodiment a complete set of all of the components that encompass work station 20 are present at each side of frame 30. Each work station 20, in the multi-station embodiment, is independent of the other work stations 20. Thus, support members 70 in the multi-station embodiment, can be positioned at varying height as compared to another to correspond to the varying heights of the individuals servicing shoes 150.

In an alternative embodiment, in lieu of providing a frame member 30, support member 70 can be permanently attached to a wall of a dwelling, such as a wall in a room of a golf clubhouse. A container 220 can also be attached to the wall member preferably above support member 70. In this embodiment, the height for support member is preferably selected to correspond to the height of the individual most likely to be performing a majority of the spike removals or replacements. Also in this embodiment the individual normally supports the weight of screwdriver 200 or drill member 250 on his or her own. However, a top member, provided with a balancing mechanism 60 and cord 62, similar to top portion 46 can also be attached to the wall above support member 70 to achieve the same weight supporting advantages as discussed above.

Ergonomic work station 20 provides for relatively quick removal and conversion of golf shoes from metal spikes to non-metal spikes, while reducing injuries associated from the repetitious movement of changing golf shoes on a regular basis.

In use, a golf shoe 150 which is to be changed to non-metal spikes or just have its metal spikes removed or replaced, is positioned on shoe holder 76 in an upside down position to provide easy access to the spikes. Balancing mechanism 60 is slid along the groove in top portion 46 of frame member 30, to position screwdriver 200 or drill 250 adjacent the shoe 150 to be worked on. The vertical height of the upside down shoe can be adjusted by moving support member 70 up or down along frame 30, as desired by the worker. Furthermore, the horizontal position of shoe 150 can be adjusted, by sliding the adjustable portion 90 of shoe holder 76, also as desired by the worker.

When all the spikes on shoe 150 have been, replaced, changed and/or removed, the worker merely slides balancing mechanism 60 along top portion 46 of frame 30, to position screwdriver 200 or drill 250 adjacent to the next shoe 150 to be serviced. The next shoe 150 is ideally positioned on one of the other provided shoe holders 76. Thus, the worker is provided with a screwdriver 200 or drill 250 appearing not to have any weight, and with the shoes in an ideal position, the job of replacing or removing the spikes on shoes 150 on a repetitive basis is made relatively comfortable and relaxing to the worker.

Furthermore, though the invention has been described above with respect to spikes associated with golf shoes, it is to be understood that the ergonomic work station of the present invention can be utilized to service spikes and cleats associated with other shoes, and can also be utilized for servicing and repairing shoes of all types. Where station 20 is utilized as a full service and repair station, various tools, drills, electric screwdriver, etc. can be interchangeably suspended from balancing mechanism 60.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An ergonomic work station for changing, removing and/or converting spikes on a shoe, said work station comprising:

a support member having a substantially vertically disposed attachment side;

at least one shoe holder attached to said vertically disposed attachment side of said support member; and means for removing one or more spikes from a shoe disposed on said shoe holder.

2. The ergonomic work station of claim 1 further including a frame member, said support member removably attached to said frame member at any one of a plurality of vertical positions along said frame member to allow said shoe holder to be positioned at any one of a plurality of vertical heights.

3. The ergonomic work station of claim 2 further including means for balancing said means for removing, said means for balancing associated with a top portion of said frame member, said means for balancing permitted to travel horizontally along the top portion of said frame member.

4. The ergonomic work station of claim 1 wherein said means for removing is a "push-to-start" electric screwdriver which is associated with one or more spike changing/removal bits.

5. The ergonomic work station of claim 1 wherein said means for removing is a drill member which is associated with one or more spike changing/removal drill bits.

6. The ergonomic work station of claim 1 wherein said support member is attached to a wall member.

7. An ergonomic work station for changing, removing and/or converting spikes on a shoe, said work station comprising:

a frame member having a top portion;

a support member adjustably attached to said frame member at any one of a plurality of vertical positions along said frame member, said support member having a substantially vertically disposed attachment side;

a plurality of shoe holders attached to said vertically disposed attachment side of said support member, each of said shoe holders maintaining a shoe disposed thereon in an upside down position;

means for removing one or more spikes from a shoe;

a balancing mechanism slidably attached to the top portion of said frame member, said balancing mechanism permitted to travel horizontally along the top portion, said balancing mechanism attached to said means for removing;

wherein said balancing mechanism is slid horizontally along the top portion of said frame member to align said means for removing with a desired shoe holder;

wherein changing an attachment position of said support member with respect to said frame member also adjusts a vertical position for said plurality of shoe holders.

8. The ergonomic work station of claim 7 further including means for transporting said work frame member.

9. The ergonomic work station of claim 8 wherein said means for transporting are a plurality of rollers disposed at a bottom portion of said frame member.

10. The ergonomic work station of claim 7 wherein said means for removing is a "push-to-start" electric screwdriver which is associated with one or more spike changing/removal bits.

11. The ergonomic work station of claim 7 wherein said means for removing is a drill member which is associated with one or more spike changing/removal drill bits.

12. The ergonomic work station of claim 7 wherein said support member is adjustably attached to a first side of said frame member and said work station further including:

a second support member adjustable attached to a second side of said frame member; and a plurality of shoe holders attached to said second support member.

13. The ergonomic work station of claim 7 wherein said frame member is attached to a wall member.

14. The ergonomic work station of claim 7 further including a storage shelf adjustably attached to said frame member above said support member.

15. The ergonomic work station of claim 7 wherein each of said plurality of shoe holders including a fixed attachment member and a shoe holding member slidably associated with said fixed attachment member, wherein said shoe holding member is permitted to travel horizontally with respect to said fixed attachment member.

16. An ergonomic work station for changing, removing and/or converting spikes on a shoe, said work station comprising:

a frame member having a top portion, a vertical middle portion and a bottom portion;

a support member adjustably and removably attached to said frame member at any one of a plurality of positions along said vertical portion, said support member having a substantially vertically disposed attachment side;

a plurality of shoe holders attached to said vertically disposed attachment side of said support member, each of said shoe holders maintaining a shoe disposed thereon in an upside down position, each of said plurality of shoe holders including a fixed attachment member and a shoe holding member slidably associated with said fixed attachment member, said shoe holding member permitted to travel horizontally with respect to said fixed attachment member;

a balancing mechanism slidably attached to the top portion of said frame member, said balancing mechanism including a cord member depending downward from said top portion, said balancing mechanism permitted to travel horizontally along the top portion; and a "push to start" electric screwdriver attached to a first end of said cord member, said electric screwdriver having a certain weight which is balanced by said balancing mechanism, said electric screwdriver associated with one or more spike changing/removal bits;

wherein said balancing mechanism is slid horizontally along the top portion of said frame member to align said means for removing with a desired shoe holder;

wherein changing an attachment position of said support member with respect to said frame member also adjusts a vertical position for said plurality of shoe holders.

17. The ergonomic work station of claim 16 further including a plurality of rollers disposed at a bottom portion of said frame member for transporting said work station.

18. The ergonomic work station of claim 16 wherein said support member is adjustably attached to a first side of the vertical portion of said frame member and said work station further including:

a second support member adjustably attached to a second side of the vertical portion of said frame member; and a plurality of shoe holders attached to said second support member.

19. The ergonomic work station of claim 16 wherein said frame member is attached to a wall member.

20. The ergonomic work station of claim 16 further including a storage shelf adjustably attached to the vertical portion of said frame member above said support member.

* * * * *